United States Patent [19]

Schmid

[11] 3,941,109

[45] Mar. 2, 1976

[54] ARRANGEMENT FOR MOUNTING A FUEL INJECTION NOZZLE

[75] Inventor: Wolfgang Schmid, Schwieberdingen, Germany

[73] Assignee: Dr. -Ing. H.c.F. Porsche Aktiengesellschaft, Germany

[22] Filed: Aug. 27, 1973

[21] Appl. No.: 391,845

[30] Foreign Application Priority Data

Aug. 31, 1972 Germany ..... 2242824

[52] U.S. Cl. ..... 123/139 AW; 123/32 R; 285/231; 285/345

[51] Int. Cl.[2] ..... F02M 61/14

[58] Field of Search ..... 123/139 AW; 239/533; 403/365, 243, 372; 285/345, 346, 231, DIG. 22

[56] References Cited

UNITED STATES PATENTS

| | | | |
|---|---|---|---|
| 2,469,448 | 5/1949 | Barber | 239/533 X |
| 3,412,718 | 11/1968 | Long | 123/32 AE |
| 3,559,892 | 2/1971 | De Luca | 239/533 |
| 3,605,703 | 9/1971 | Moulds | 123/32 EA X |
| 3,628,816 | 12/1971 | Ross, Jr. | 403/243 X |
| 3,657,943 | 4/1972 | Bruhn, Jr. et al. | 403/372 X |
| 3,776,209 | 12/1973 | Wertheimer et al. | 123/139 AW X |
| 3,782,639 | 1/1974 | Boltz et al. | 123/139 AW X |
| 3,783,844 | 1/1974 | Gural | 123/139 AW X |
| 3,791,591 | 2/1974 | Hedges | 239/533 |

FOREIGN PATENTS OR APPLICATIONS

| | | | |
|---|---|---|---|
| 624,748 | 6/1949 | United Kingdom | 403/372 |

*Primary Examiner*—Charles J. Myhre
*Assistant Examiner*—Tony Argenbright
*Attorney, Agent, or Firm*—Craig & Antonelli

[57] ABSTRACT

An arrangement for mounting a fuel injection nozzle which is arranged in an aperture of the cylinder head of an internal combustion engine; the aperture is thereby provided with a recess, by means of which a form-locking connection is established with the cylinder head by the use of an elastic part of the fuel injection nozzle.

10 Claims, 2 Drawing Figures

ARRANGEMENT FOR MOUNTING A FUEL INJECTION NOZZLE

The present invention relates to an arrangement for the mounting support of a fuel injection nozzle arranged in an opening of a cylinder head of an internal combustion engine.

It is known in the prior art (German Auslegesschrift 1,116,476) to connect fuel injection nozzles by threaded connections with the cylinder head of an internal combustion engine. The increased manufacturing costs resulting from the thread-cutting in the cylinder head and at the fuel injection nozzle have thereby proved disadvantageous. Also, the exchange of defective fuel injection nozzles was frequently possible only with considerable force application.

The object of the present invention resides in providing an arrangement for the mounting support of a fuel injection nozzle arranged in an opening of the cylinder head which does not entail the aforementioned disadvantages.

This is achieved according to the present invention in that the opening is provided with recess, by means of which the fuel injection nozzle provided with an elastic part is form-lockingly connected with the cylinder head. It is thereby possible that the recess is arranged in the cylinder head itself, or that the recess is arranged in a sleeve arranged in the cylinder head opening and rigidly connected with the cylinder head. The elastic part includes a collar which together with the recess forms the form-locking connection between the cylinder head and the fuel-injection nozzle. The elastic part is thereby advantageously made of rubber of similar material. It has proved as very favorable that the fuel injection nozzle is provided with a recess along the outer circumference thereof, by means of which together with a collar or annular bead of the rubber ring forming the elastic part, the injection nozzle is form-lockingly connected with the elastic part.

The advantages achieved with the present invention reside in particular in that the arrangement according to the present invention for the mounting support of a fuel injection nozzle arranged in an opening of the cylinder head of an internal combustion engine can be manufactured in a simple manner with low manufacturing costs and the fuel injection nozzle can be easily and rapidly exchanged.

Figure 1:
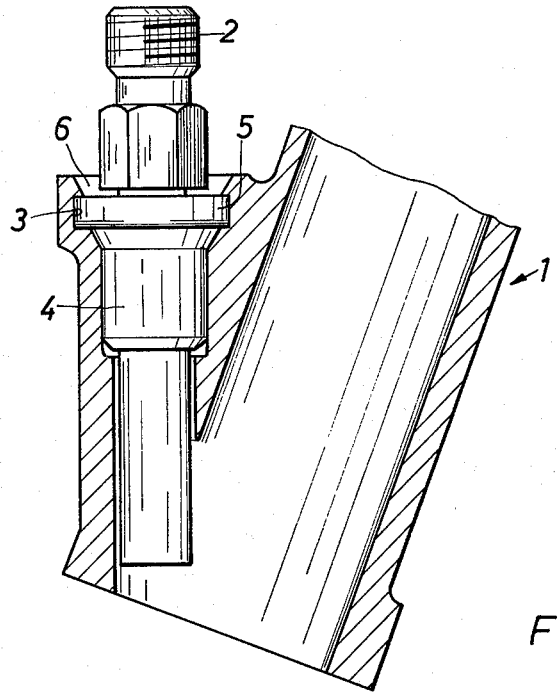
Figure 2:
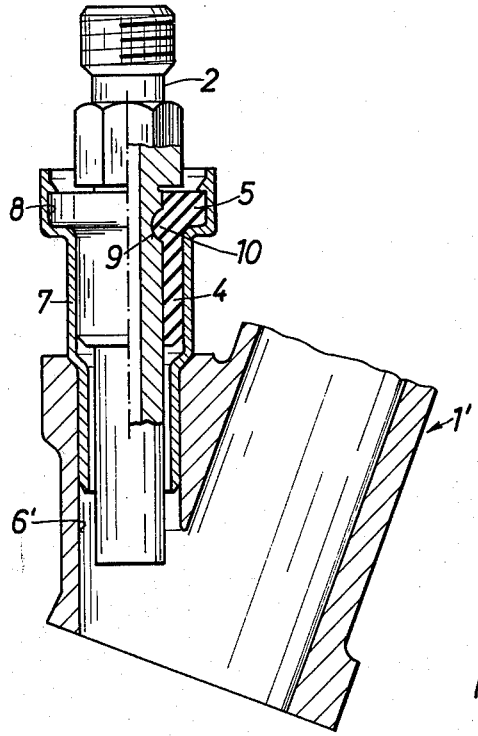

These and other objects, features, and advantages of the present invention will become more apparent from the following description when taken in connection with the accompanying drawing which shows, for purposes of illustration only, two embodiments in accordance with the present invention, and wherein:

FIG. 1 is a partial cross-sectional view through a part of a cylinder head with a fuel injection nozzle whereby the recess is arranged in the cylinder head itself; and FIG. 2 is a partial cross-sectional view through a part of a cylinder head with a fuel injection nozzle whereby the recess is arranged in a sleeve rigidly connected with the cylinder head and arranged in the cylinder head opening.

Referring now to the drawing wherein like reference numerals are used throughout the two views to designate like parts, and more particularly to FIG. 1, reference numeral 1 generally designates in this figure a cylinder head while reference numeral 2 designates a fuel injection nozzle, reference numeral 3 a recess in the cylinder head 1 and reference numeral 4 a rubber ring which includes a collar 5. The fuel injection nozzle 2 is arranged in an opening 6 of the cylinder head 1.

In FIG. 2 a sleeve 7 extends into the opening 6 whereby the sleeve 7 is rigidly connected with the cylinder head 1. The sleeve 7 is provided with a recess 8 and the fuel injection nozzle 2 with an annular recess or indentation 9 into which projects an annular bead 10 of the rubber ring 4, whence the fuel injection nozzle 2 and the rubber ring 4 are form-lockingly connected with each other. It is advantageous if the opening 6 (FIG. 1) and the sleeve 7 (FIG. 2) are constructed conically in the upper area thereof in the manner illustrated in the drawing for the facilitated insertion of the collar 5 into the opening 6 or into the sleeve 7.

If the fuel injection nozzle 2 of the cylinder head 1 (FIG. 1) is to be exchanged, then the form-locking connection between the collar 5 of the rubber ring 4 and the recess 3 of the cylinder head 1 is disengaged by a simple pulling action and the fuel injection nozzle 2 is removed out of the cylinder head opening 6. The new fuel injection nozzle is then forced so far into the opening 6 until a form-locking connection between the fuel injection nozzle and the cylinder head is established by means of the recess 3 and the collar 5.

During the exchange of the fuel injection nozzle 2 of the cylinder head 1′ (FIG. 2), one proceeds in an analogous manner, with only the difference that the form-locking connection is established between the recess 8 of the sleeve 7 and the collar 5 of the rubber ring 4.

While I have shown and described only two embodiments in accordance with the present invention, it is understood that the same is not limited thereto but is susceptible of numerous changes and modifications as known to those skilled in the art. Thus, for example, the construction of the recess 3 or 8 may be of any desired shape and the aperture 6 or 6′ may be arranged directly in the cylinder head or in the suction pipes connected therewith. Hence, I do not wish to be limited to the details shown and described herein but intend to cover all such changes and modifications as are encompassed by the scope of the appended claims.

What I claim is:

1. In an internal combustion engine having a cylinder head and at least one fuel injection nozzle, an improved mounting arrangement for said fuel injection nozzle in said cylinder head, said improved mounting arrangement comprising:

aperture means provided with respect to said cylinder head for receiving the nozzle therein, said aperture means including a recess means disposed within said aperture means, and elastic means coupled to said nozzle for form-lockingly engaging said recess means, wherein the nozzle is retained in said aperture means in a threadless and readily removable manner by said elastic means.

2. A mounting arrangement according to claim 1, wherein said aperture means includes one of a bore in said cylinder head and a sleeve rigidly secured to said cylinder head in said bore.

3. A mounting arrangement according to claim 1, wherein said elastic means includes a ring structure mounted on said nozzle, said ring structure including a collar for matingly engaging said recess means.

4. A mounting arrangement according to claim 3, wherein said recess means includes an annular groove.

5. A mounting arrangement according to claim 3, wherein said nozzle includes an outer peripheral surface having an annular groove, and said ring structure includes an inner peripheral surface having an annular bead, said annular bead engaging said annular groove for form-lockingly connecting said ring structure to said nozzle.

6. A mounting arrangement according to claim 3, wherein said recess means consists essentially of rubber-like material.

7. A mounting arrangement according to claim 1, wherein said aperture means includes a bore in said cylinder head, said recess means being an annular groove provided in said cylinder head.

8. A mounting arrangement according to claim 1, wherein said aperture means includes a sleeve rigidly secured in a bore in said cylinder head, said recess means being an annular groove provided in said sleeve.

9. A mounting arrangement according to claim 1, wherein said aperture means includes an inlet end having a conical shape for facilitating entry of said elastic means into said aperture means.

10. A mounting arrangement according to claim 1, wherein the nozzle is form-lockingly retained within the eastic means such that the nozzle and the elastic means are removable from the cylinder head as a unit.

* * * * *

UNITED STATES PATENT OFFICE

CERTIFICATE OF CORRECTION

Patent No. 3,941,109 Dated March 2, 1976

Inventor(s) Wolfgang SCHMID

It is certified that error appears in the above-identified patent and that said Letters Patent are hereby corrected as shown below:

Claim 6, line 2, change "recess" to --elastic--

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*